US007345644B2

(12) United States Patent
Morioka et al.

(10) Patent No.: US 7,345,644 B2
(45) Date of Patent: Mar. 18, 2008

(54) ANTENNA DEVICE, AND METHOD OF MANUFACTURING ANTENNA DEVICE

(75) Inventors: Susumu Morioka, Saitama (JP); Takashi Takano, Tokyo (JP); Shigeru Saegusa, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/549,671

(22) PCT Filed: Mar. 11, 2004

(86) PCT No.: PCT/JP2004/003214

§ 371 (c)(1),
(2), (4) Date: Jun. 21, 2006

(87) PCT Pub. No.: WO2004/084348

PCT Pub. Date: Sep. 30, 2004

(65) Prior Publication Data

US 2006/0238430 A1 Oct. 26, 2006

(30) Foreign Application Priority Data

Mar. 19, 2003 (JP) ..... 2003-076426

(51) Int. Cl.
*H01Q 7/00* (2006.01)

(52) U.S. Cl. ..... 343/866; 343/741; 343/841

(58) Field of Classification Search ..... 343/741, 343/742, 866, 870, 841, 867
See application file for complete search history.

(56) References Cited

U.S. PATENT DOCUMENTS 1,673,429 A 6/1928 Vinson
2,349,154 A 5/1944 Finch et al.
2,411,198 A * 11/1946 Eltgroth ..... 342/417
2,465,381 A 3/1949 Libby
4,278,980 A * 7/1981 Ogita et al. ..... 343/748
5,883,574 A 3/1999 Asbrink (Continued)

FOREIGN PATENT DOCUMENTS

DE 618511 9/1935

(Continued)

OTHER PUBLICATIONS

"Electrostatic Shielded Magnetic Look Antenna" IBM Technical Disclosure Bulletin, IBM Corp. New York, US, vol. 32, No. 1, Jun. 1 1989 p. 18, XP000033231.

*Primary Examiner*—Hoang V. Nguyen
(74) *Attorney, Agent, or Firm*—Finnegan, Henderson, Farabow, Garrett & Dunner, L.L.P.

(57) ABSTRACT

A loop antenna device includes a loop antenna having a high noise resistance performance. In a loop antenna having a shield member covering a looped conductor portion formed in a loop shape from a conductive wire, a non-covered portion where the looped conductor portion is not covered is formed in correspondence with a portion of the conductive wire including a reference position for the symmetry of two terminals for connection between the antenna device and a reception circuit. This provides a balanced shield structure. Besides, a line for connecting one end of the conductive wire to the ground potential and a line for connecting the shield member to the ground potential are individually separate from each other, whereby reception of a voltage fall due to common impedance by the antenna is suppressed.

7 Claims, 6 Drawing Sheets

U.S. PATENT DOCUMENTS

| | | | |
|---|---|---|---|
| 6,137,447 | A | 10/2000 | Saitoh et al. |
| 6,883,574 | B2 | 4/2005 | Chapman |

FOREIGN PATENT DOCUMENTS

| | | | |
|---|---|---|---|
| DE | 31 40319 | A1 | 4/1983 |
| EP | 0 766 200 | A2 | 1/1982 |
| FR | 900 276 | A | 6/1945 |
| JP | 56-27509 | | 3/1981 |
| JP | 57-002102 | | 1/1982 |
| JP | 57-52118 | | 3/1982 |
| JP | 2002-190705 | | 7/2002 |

* cited by examiner

ANTENNA DEVICE, AND METHOD OF MANUFACTURING ANTENNA DEVICE

This application is a 371 of PCT/JP04/03214 dated 11 Mar. 2004.

TECHNICAL FIELD

The present invention relates to an antenna device including a so-called loop antenna having a loop shape, and a method of manufacturing such an antenna device.

BACKGROUND ART

In AV apparatuses in recent years, a switching power supply circuit is mounted in many cases for reductions in power consumption and size, for example. It is known that the switching power supply circuit generates switching noises at comparatively high frequencies. In addition, in AV digital apparatuses represented, for example, by CD players, high-frequency noises are generated from digital circuits. In short, in the AV apparatuses and the like in recent years, there is a tendency of increases in high-frequency noises, as the so-called in-apparatus noises.

Those AV apparatuses which incorporate a radio tuner have been wide spread. Where such an AV apparatus having a radio tuner is generating the above-mentioned in-apparatus noises, the antenna for receiving the radio broadcasting wave meets the inconvenience that the noises are received as disturbance noises.

Besides, in recent years, electronic apparatuses have been digitized, so that the noises propagating through electric light wires tend to increase, and the noises from the light wires are also a major cause of the disturbance noises received by the antenna.

FIG. 6 schematically illustrates the principle of the above-mentioned reception of disturbance noises by an antenna.

An AV apparatus 20 is, for example, an apparatus including at least a radio tuner, and an antenna 30 is connected to the AV apparatus 20 through a feeder 31.

In the AV apparatus 20, the noise generated as above generates a noise potential between the AV apparatus 20 and ground. Here, for example, if the noise generated in the AV apparatus 20 is conducted through the feeder 31, a component as noise current flows into the feeder 31 and the antenna 30 when an electric wave is radiated from the antenna 30 due to the potential difference between the AV apparatus 20 and ground. As a result, the noise current is received by the antenna 30 as a disturbance noise.

A general example of the AM antenna in recent years is a loop antenna obtained by a method in which an about 1 m lead wire having a non-shield structure is formed into a loop shape. Therefore, where the antenna 30 shown in FIG. 6 is an AM antenna, the antenna tends to receive disturbance noises, which is particularly a problem.

In view of this, a configuration for making a countermeasure against noise in relation to a loop antenna, for example, is disclosed in Japanese Patent Laid-open No. Sho 57-2102. In the configuration described in Japanese Patent Laid-open No. Sho 57-2102, a coaxial cable composed of a core wire and a shield conductor surrounding the core wire is used for the loop antenna. In addition, the shield conductor of the coaxial cable is cut at positions equally spaced from input/output terminals. Incidentally, in the case of this configuration, the shield conductor in one coaxial cable is divided into two portions, with the cutting position as a boundary, and, therefore, these shield conductors are connected to the ground potential. This makes it possible to effectively reduce the noise received by the loop antenna, as compared with the case where the shield is applied to the whole part of the loop antenna, for example.

However, it is desirable for the loop antenna to be further improved in the reception of disturbance noises. It is an object of the present invention to further reduce the disturbance noise received by a loop antenna. It is another object of the present invention to ensure that the loop antenna provided with such a noise-reducing configuration can be manufactured efficiently.

DISCLOSURE OF INVENTION

In view of the foregoing, according to the present invention, an antenna device is configured as follows.

The antenna device includes a looped conductor portion having a looped conductive wire, and a shield member which as a whole covers the looped conductor portion and which has a non-covered portion where the shield member does not covers the looped conductor portion, the non-covered portion corresponding to a portion of the conductive wire including a reference position concerning the symmetry of two terminals for connection between the antenna device and a reception circuit. In addition to and simultaneously with this, a first line for connecting one end of the conductive wire to ground and a second line for connecting the shield member to ground are physically individually provided.

According to the above configuration, a structure in which the periphery of the looped conductor portion obtained by forming a conductive wire into a loop shape is covered by the shield member is adopted as a basic configuration of the antenna device. In addition to this, the non-covered portion where the looped conductor portion is not covered is formed correspondingly to the portion of the conductive wire including the reference position concerning the symmetry of two terminals for connection between the antenna device and a reception circuit. This makes it possible to obtain a balanced structure in which noise currents in opposite directions flow in the shield member with the non-covered portion as a boundary, whereby the noise current components can be reduced by canceling each other.

Further, the line for connecting one end of the conductive wire to ground and the line for connecting the shield member to ground are physically individually provided. This makes it difficult for the influence of a voltage fall due to common impedance between the lines to be exerted on the conductive wire.

Besides, a method of manufacturing an antenna device includes, at least the steps of: arranging a conductive foil member as a shield member for shielding a looped conductor portion, relative to a spool portion placed along a loop shape of the looped conductor portion in a spool member, the conductive foil member being not arranged at a position corresponding to a portion of the looped conductor portion including a reference position concerning the symmetry of connection portions for connecting both end portions of the looped conductor portion to the reception circuit side; winding a conductive wire as the looped conductor portion around the spool portion from the upper side of the conductive foil member arranged by the arranging step; and covering the conductive wire with the conductive foil member so that the conductive wire wound by the winding step is covered with the conductive foil member.

In the above manufacturing method, first, the conductive foil member is arranged relative to the spool portion of the spool member so as to provide a portion where the conductive foil member is not located. The portion where the conductive foil member is not located constitutes the above-mentioned non-covered portion. From the upper side of the conductive foil member thus arranged, the conductive wire as the looped conductor portion is wound around the spool portion, thereby forming the conductive wire into a loop shape. Further, the conductive wire thus wound is covered by the conductive foil member, whereby the conductive foil member is made to function as a shield member for the conductive wire.

According to the above manufacturing method, it is possible to manufacture an antenna device in which the looped conductor portion is covered by the shield member and in which the non-covered portion is formed. In addition, the manufacturing steps can be performed through simple operations of arranging and winding the conductive foil member and the conductive wire relative to and around a spool portion.

BEST MODE FOR CARRYING OUT THE INVENTION

Now, embodiments of the present invention will be sequentially described below. This embodiment will be described by taking as an example the case where the loop antenna is an AM antenna device corresponding to AM broadcasting.

Figure 5A:
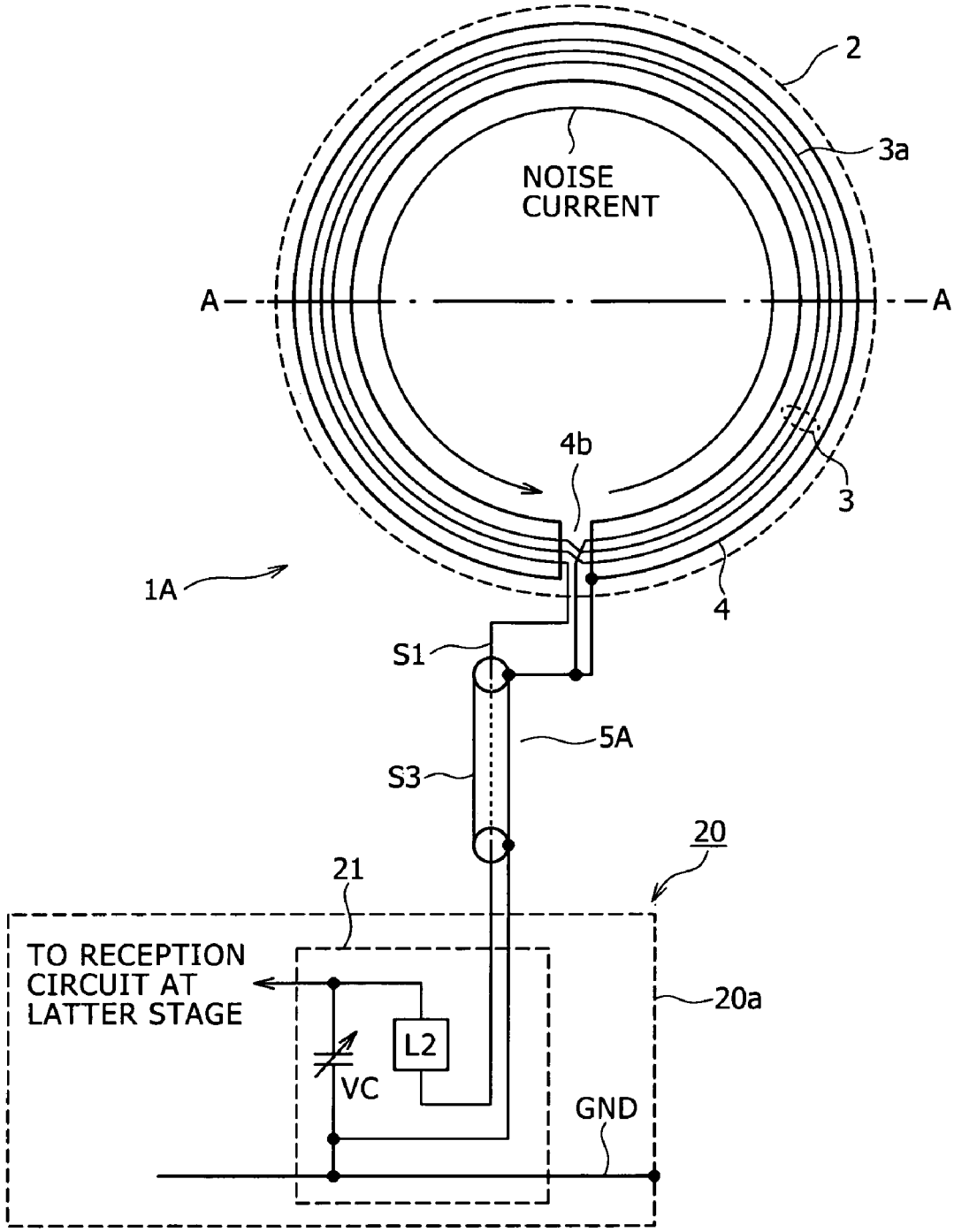
FIGS. 5A and 5B show an exemplary configuration of a loop antenna having a shield structure.
Figure 5B:
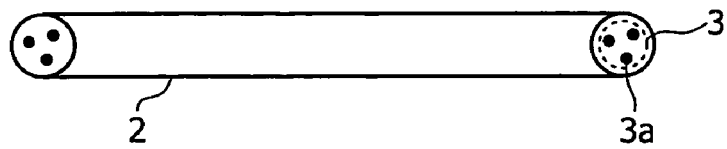

Here, in the case where a countermeasure against noises is applied to a loop antenna type AM antenna, a configuration as shown in FIGS. 5A and 5B may be contemplated.

FIG. 5A is a view, from the front side, of an AM antenna device 1A, and FIG. 5B shows a sectional view along line A-A of FIG. 5A.

As shown in FIGS. 5A and 5B, the AM antenna device 1A is composed of a loop antenna portion 2 including a looped conductor portion 3 and a shield pipe member 4, and a feeder 5A for connecting the loop antenna portion 2 to the reception circuit side of an AV apparatus 20 to supply electric power.

In the loop antenna portion 2, the looped conductor portion 3 is formed by winding a conductive wire 3*a* into a loop form by a desired number of turns. The looped conductor portion 3 is provided in the state of being contained in the tube of the shield pipe member 4 formed by forming a pipe-like member into a loop shape. The shield pipe member 4 is formed of a conductive material such as a metal, and, therefore, the shield pipe member 4 can provide an electrostatic shield effect on the loop antenna portion 2.

In addition, the AM antenna device 1A has the feeder 5A for connection between the loop antenna portion 2 side and a reception circuit on the AV apparatus 20 side.

The feeder 5A in this case is a so-called single-core-shield cable, which has a single core wire S1 and a covered wire S3 covering the core wire S1 to thereby give an electrostatic shield effect.

The core wire S1 is for providing a structure in which one end of the conductive wire 3*a* led out of a cut portion 4*b* formed by cutting a portion of the shield pipe member 4 is connected to the signal line side of a tuning circuit 21 in the AV apparatus 20. In addition, the covered wire S3 connects the shield pipe member 4 and the other end portion of the conductive wire 3*a* to ground GND on the AV apparatus 20 side, as shown in the figures.

The AV apparatus 20 in this case includes a tuner (reception circuit) capable of receiving AM radio broadcasting, at least. Here, the tuning circuit 21 composed of a tuning coil L2 and a tuning variable condenser Vc is shown as the reception circuit.

Figure 6:
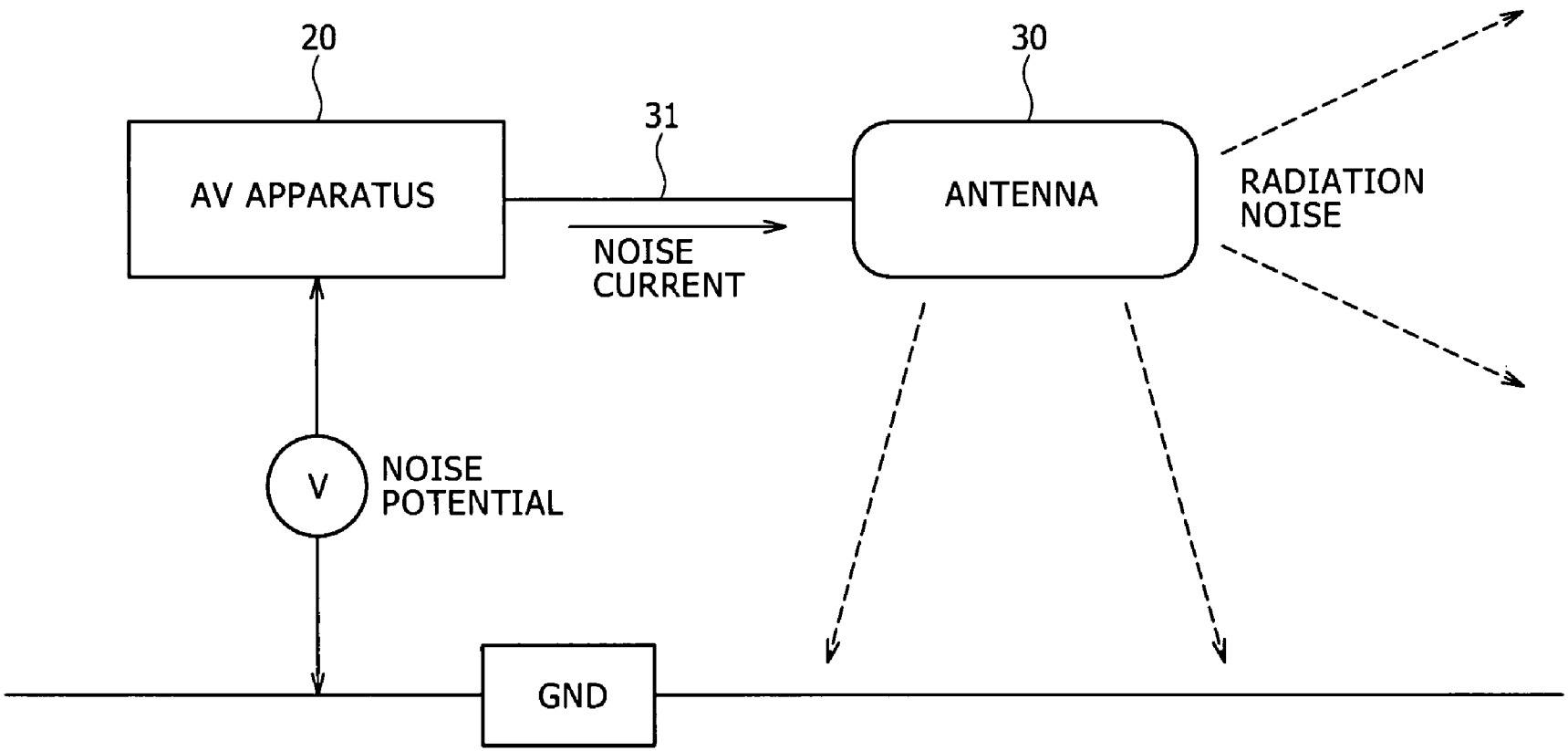
FIG. 6 schematically illustrates the principle of the reception of disturbance noise by an antenna.

As has been described referring to FIG. 6, for example, the noise radiated from a digital circuit and a switching power supply circuit in the AV apparatus 20, the electric light wire noise propagating from a power supply line, and the like flow as noise currents on the antenna side, and the noise currents are received as disturbance noises on the antenna side.

However, in the AM antenna device 1A shown in FIGS. 5A and 5B; the loop antenna portion 2 is electrostatically shielded by the shield pipe member 4, whereby reception of disturbance noises is suppressed.

In this embodiment, based on the above-mentioned structure, an AM antenna device further enhanced in resistance against disturbance noise is configured.

Figure 1A:
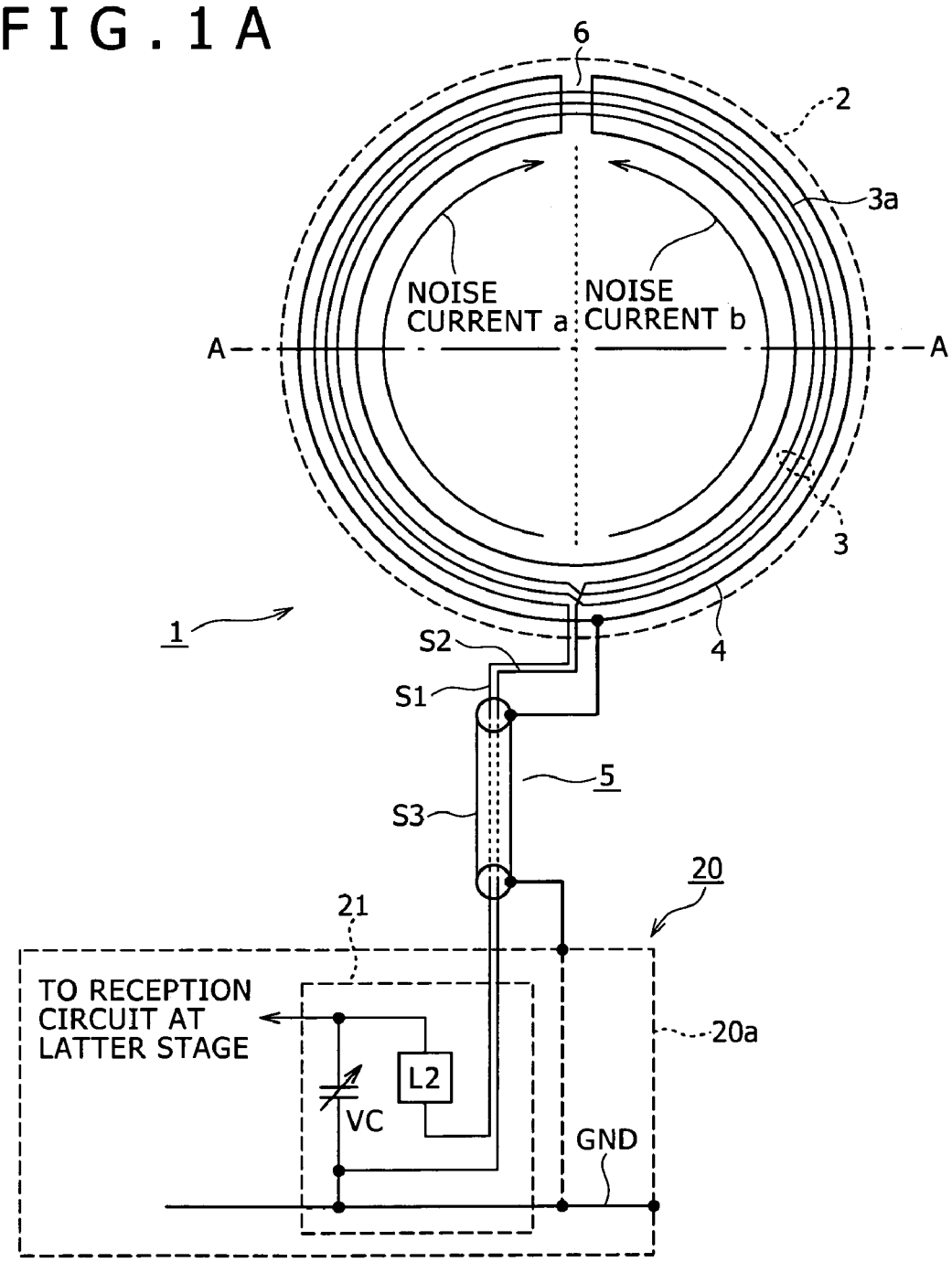
FIGS. 1A and 1B show an exemplary configuration of an AM antenna device according to a first embodiment of the present invention.
Figure 1B:
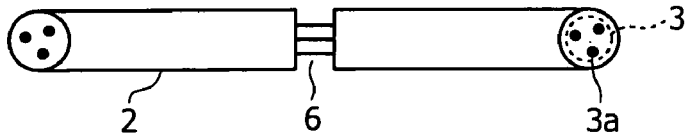

FIGS. 1A and 1B show an exemplary configuration of an AM antenna device 1 as a first embodiment of the present invention. FIG. 1A is a view, from the front side, of the AM antenna device 1, and FIG. 1B shows a sectional view along line A-A of FIG. 1A.

As shown in FIGS. 1A and 1B, the AM antenna device 1 in this embodiment is composed of a loop antenna portion 2 including a looped conductor portion 3 and a shield pipe member 4, and a feeder 5 for connecting the loop antenna portion 2 to the reception circuit side of an AV apparatus 20 to thereby supply electric power.

In the loop antenna portion 2, the looped conductor portion 3 is formed in a structure in which a conductive wire 3*a* having a length corresponding to an inductance matched to the AM band is wound into a loop shape by a required number of turns. Incidentally, it should be noted here that a wire having an insulation coating, for example, a vinyl resin coating to a conductive core wire is used as the conductive wire 3*a*.

The looped conductor portion 3 is provided in the state of being contained in the shield pipe member 4 produced by forming a pipe-like member into a loop shape. The shield pipe member 4 is formed of a conductive material such as a metal, so that the shield pipe member 4 is covering the looped conductor portion 3. In other words, the shield pipe member 4 functions as a shield member for applying an electrostatic shield to the loop antenna portion 2.

Further, in this embodiment, a part of the loop shape of the shield pipe member 4 is cut, to form a non-covered portion 6 where the looped conductor portion 3 is not covered.

In addition, the AM antenna device 1 in this embodiment has the feeder 5 for connection between the loop antenna portion 2 side and a reception circuit on the AV apparatus 20 side.

The feeder 5 is a so-called double-core shield cable, which includes two core wires S1 and S2 and a covered wire S3 covering these core wires to thereby give an electrostatic shield effect.

Of the core wires constituting the feeder 5, one core wire S1 is for connecting one end of the conductive wire 3*a* to the signal line side of a tuning circuit 21 in the AV apparatus 20. The other core wire S2 is for connecting the other end of the conductive wire 3*a* to the ground GND of the AV apparatus 20.

In addition, the covered wire S3 connects the shield pipe member 4 to the ground GND on the AV apparatus 20 side, as shown in the figures. In this case, a metallic portion of a casing 20*a* of the AV apparatus 20 and the other end portion of the covered wire S3 are connected to each other, whereby the shield pipe member 4 is connected to the ground GND.

The AV apparatus 20 in this case includes a tuner (reception circuit) capable of receiving AM radio broadcasting, at least; here, the tuning circuit 21 is shown as the reception circuit. As shown in the figures, the tuning circuit 21 is composed of a tuning coil L2 and a tuning variable condenser Vc, and a predetermined reception frequency corresponding to the AM band is set depending on the time constants of these components. A reception signal tuned by the tuning circuit 21 is transmitted to the reception circuit at the latter stage, where it is subjected to a required processing.

With the configuration of the AM antenna device 1 shown in FIGS. 1A and 1B, first, the shield pipe member 4 applies an electrostatic shield to the loop antenna portion 2, whereby reception of disturbance noises is suppressed. This point is the same as in the AM antenna device 1A shown in FIGS. 5A and 5B.

In addition, in this embodiment, the shield pipe member 4 is provided with the non-covered portion 6 at the position shown in the figures, whereby the physical connection of the shield pipe member 4 here is cut; as a result of this, electrical connection of the shield pipe member 4 is also interrupted at the position of the non-covered portion 6.

In this case, conductive wires 3*a* are led out from a radial position opposite to the non-covered portion 6 in the shield pipe member 4, and, at the lead-out position, the conductive wires 3*a* are connected to the core wires S1, S2 of the feeder 5. In addition, the shield pipe member 4 is also connected to a covered wire S3 of the feeder 5 at the lead-out position. As a result, the non-covered portion 6 as viewed from the reception circuit side is located at the midpoint of the whole length of the conductive wires 3*a*. In other words, the end portions of the conductive wire 3*a* are symmetrical with each other, with the position of the non-covered portion 6 as a reference position.

When the above-mentioned relationship between the non-covered portion 6 and the conductive wire 3*a* is established, a noise current component flowing in the conductive wire 3*a* is transmitted through electromagnetic coupling to the shield pipe member 4, so that the noise current flows also in the shield pipe member 4.

Here, the noise current flowing in the shield pipe member 4 is composed of a noise current a and a noise current b as indicated by arrows in FIG. 1A, i.e., noise currents with opposite polarities flow. Specifically, let the lead-out position of the conductive wire 3*a* be a base point, when the noise current a flows in the portion of the shield pipe member 4 on the left side in the figure in the direction from the lead-out position of the conductive wire 3*a* toward the non-covered portion 6, the noise current b flows in the portion of the shield pipe member 4 on the right side in the figure in the reverse direction, i.e., in the direction from the lead-out position of the conductive wire 3*a* toward the non-covered portion 6.

In addition, in this case, the end portions of the conductive wire 3*a* are symmetrical with each other, with the position of the non-covered portion 6 as a reference position, so that the noise currents a and b thus generated have opposite polarities and have substantially the same level.

In short, in this embodiment, a balanced shield structure is realized, whereby the noise currents a and b flowing in the shield pipe member 4 are made to substantially cancel each other.

In contrast, in the structure of the loop antenna portion 2 shown in FIGS. 5A and 5B, the noise current flows in the same direction along the loop shape of the shield pipe member 4, for example with the position corresponding to the cut portion 4*b* as a base point, as indicated by arrow in the figures. In short, the structure in this case is different from the balanced structure shown in FIGS. 1A and 1B, and, therefore, the above-mentioned canceling effect of noise current components cannot be obtained.

Namely, the antenna device 1 shown in FIGS. 1A and 1B adopts the balanced shield structure and, therefore, it is ensured that disturbance noises are less liable to be received, as compared with the case of the antenna device 1A shown in FIGS. 5A and 5B.

Further, in the antenna device 1 shown in FIGS. 1A and 1B, a double-core shield cable is adopted as the feeder 5. Besides, by utilizing the structure of two core wires, the core wire S2 not used for connection of signal lines is utilized to connect one end of the conductive wire 3*a* to the ground GND. As for the connection between the shield pipe member 4 and the ground GND, the covered wire S3 is used.

For example, in the configuration shown in FIGS. 5A and 5B, the feeder 5A is composed of a single-core shield cable, and the covered wire S3 is used in common for grounding of the conductive wire 3*a* and for grounding of the shield pipe member 4. On the other hand, in the antenna-device 1 shown in FIGS. 1A and 1B which adopts the above-described configuration, the line for grounding the conductive wire 3*a* serving as a conductor of the antenna and the line for grounding the shield pipe member 4 are individually different lines. This reduces the influence of the voltage fall due to the common impedance between the conductive wire 3*a* and the shield pipe member 4. In short, the grounding structure shown in FIGS. 1A and 1B is stronger against noises, as compared with the grounding structure for the conductive wire 3*a* and the shield pipe member 4 shown in FIGS. 5A and 5B.

Thus, in the antenna device 1 shown in FIGS. 1A and 1B, the balanced shield structure is adopted for the loop antenna portion 2 and, in addition, the grounding structure for the conductive wire and the shield member uses the different lines for the grounding of these components. This combination provides the antenna device 1 shown in FIGS. 1A and 1B with a much higher noise resistance performance than that of, for example, the antenna device 1A shown in FIGS. 5A and 5B.

In the antenna described, for example, in Japanese Patent Laid-open No. Sho 57-2102, the above-mentioned grounding structure for the conductive wire and the shield member shown in FIGS. 1A and 1B is not adopted. Therefore, as compared with the antenna described in Japanese Patent Laid-open No. Sho 57-2102, also, the antenna device 1 according to this embodiment shown in FIGS. 1A and 1B can has a better noise resistance performance.

Incidentally, the grounding structure for the conductive wire and the shield member as this embodiment can also be obtained by a method in which a single-core cable is used as the feeder, the conductive wire 3*a* is connected by the core wire in the same manner as in FIGS. 5A and 5B, and the shield pipe member 4 is connected to the ground by use of a separate wire. However, the use of the double-core shield cable as shown in FIGS. 1A and 1B promises efficient wiring and an enhanced shield effect for the feeder, and is therefore more rational.

As is well known, it is further preferable that the double-core shield cable is a double-core shield cable in which two core wires are twisted around each other.

Figure 2:
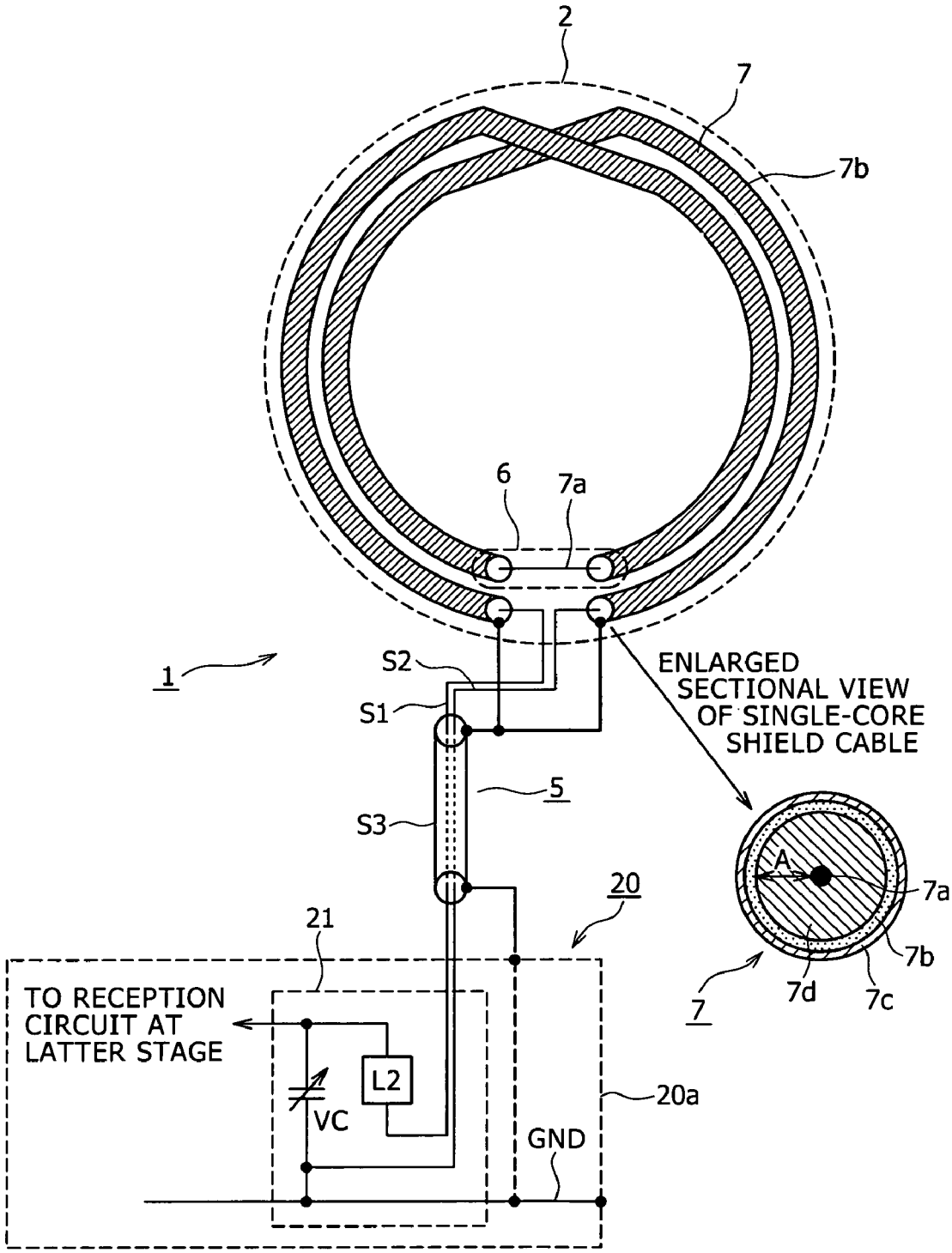
FIG. 2 shows an exemplary configuration of an AM antenna device according to a second embodiment of the present invention.

FIG. 2 shows an exemplary configuration of an AM antenna device 1 as a second embodiment. Incidentally, the same portion as those in FIGS. 1A and 1B are denoted by the same symbols as used above, and the same descriptions as above will be omitted.

A loop antenna portion 2 shown in FIG. 2 has a single-core shield cable 7. The single-core shield cable 7 is composed of a single core wire 7*a*, and a covered wire 7*b* for covering, and thereby shielding, the core wire 7*a*. The core wire 7*a* is provided with a predetermined length according to an inductance necessary for an AM antenna. The single-core shield cable 7 is formed into a loop shape by a predetermined number of turns.

In the loop antenna portion 2 formed in this manner, the core wire 7*a* corresponds to the conductive-wire 3*a* in FIGS. 1A and 1B, and the whole part of the loop shape of the core wire 7*a* formed attendant on the formation of the single-core shield cable 7 into a loop shape corresponds to the looped conductor portion 3. In addition, the covered wire 7*b* corresponds to the shield pipe member 4 (i.e., the shield member) shown in FIGS. 1A and 1B. Namely, in the second embodiment, the formation of the single-core shield cable 7 into a loop shape provides a loop antenna of an electrostatic shield structure.

For example in the structure shown in FIGS. 1A and 1B, the bundle formed by winding the conductive wire 3*a* is covered by the shield pipe member 4 used as the shield member; on the other hand, in the configuration shown in FIG. 2, the covered wire 7*b* is also wound, together with the core wire 7*a* serving as the conductive wire.

Even in the structure shown in FIG. 2, however, since the core wire 7*a* as the conductive wire is shielded by the covered wire 7*b*, the entire part thereof is equivalent to the structure in which the loop conductor portion 3 is covered, and a shield effect equivalent to the above-mentioned is also obtained.

In addition, as the loop antenna portion 2 shown in FIG. 2, also, a non-covered portion 6 for providing a balanced shield structure is formed.

The non-covered portion 6 is provided in correspondence to a reference position for the symmetry of connection portions for connecting both end portions of the conductive wire of the loop antenna portion to the reception circuit portion side.

Therefore, in the case where the loop antenna portion 2 is formed by use of the single-core shield cable 7 as shown in FIG. 2, it suffices that the covered wire 7*b* is cut at a position corresponding to a roughly midpoint of the whole length of the single-core shield cable 7. In view of this, in FIG. 2, the position of the non-covered portion 6 in the loop shape of the loop antenna portion 2 and the position of connection of the single-core shield cable 7 to the feeder 5 side are located at roughly the same circumferential position.

In addition, both end portions of the core wire 7*a* of the single-core shield cable 7 are connected respectively to the core wires S1 and S2 of the feeder 5 composed of a double-core shield cable, whereby a signal line of a tuning circuit 21 on the AV apparatus 1 side is connected to the ground GND. Besides, the covered wire 7*b* of the single-core shield cable 7 corresponding to the shield member is connected through a covered wire S3 of the feeder 5 to a casing 20*a*, which is grounded to the ground GND of the AV apparatus 20.

Namely, in the second embodiment, also, the same grounding structure as in FIGS. 1A and 1B is adopted.

Where the AM antenna device 1 according to the second embodiment is configured in this manner, it suffices that the single-core shield cable 7 provided with the portion where the core wire 7*a* is not covered by the covered wire 7*b* as the non-covered portion 6 is formed into a loop shape. Namely, the loop antenna portion 2 can be produced by a simple operation.

In addition, the actual manufacturing step for providing the single-core shield cable 7 with the portion as the non-covered portion 6 may be conducted as follows.

In one aspect, a portion of a length necessary for forming the loop antenna 2 is cut off from, for example, a roll of a single-core shield cable, to prepare one single-core shield cable 7. At a position of the single-core shield cable 7 at which to form the non-covered portion 6 (roughly midpoint position), only the covered wire 7*b* is cut, leaving the core wire 7*a* uncut.

Or, alternatively, two single-core shield cables with a length corresponding approximately to ½ times the whole length of the single-core shield cable 7 with a length necessary for forming the loop antenna portion 2 are prepared. Then, at end portions on one side of the single-core shield cables, the core wires 7*a* are exposed by a required length, and the thus exposed core wires 7*a* are connected to each other, for example, by soldering or by use of a connector such as a connecting terminal.

Incidentally, as a result of the above operation only, the portions of the covered wire 7*a* at the non-covered portion 6 are left exposed; for protecting these portions against careless shortcircuit or cutting, therefore, the non-covered portion 6 is preferably protected by use of an insulating material such as an insulating tube. This applies also to the loop antenna portion 2 shown in FIGS. 1A and 1B above.

Meanwhile, as for example shown in an enlarged sectional view in FIG. 2, when the single-core shield cable 7 has a structure in which the periphery of a core wire 7*a* is covered with an insulating material 7*d* in a comparatively large thickness and a covered wire 7*b* and an insulation coating 7*c* are provided on the periphery of the insulating material 7*d*, the spacing A between the core wire 7*a* and the covered wire 7*b* is comparatively large. The large spacing between the core wire 7*a* and the covered wire 7*b* leads to a low floating capacity between the core wire 7*a* and the covered wire 7*b*, and the noise resistance performance is enhanced accordingly. Namely, in the configuration shown in FIG. 2, the use of the single-core shield cable 7 for the loop antenna portion 2 provides a lowering effect on floating capacity.

Figure 3A:
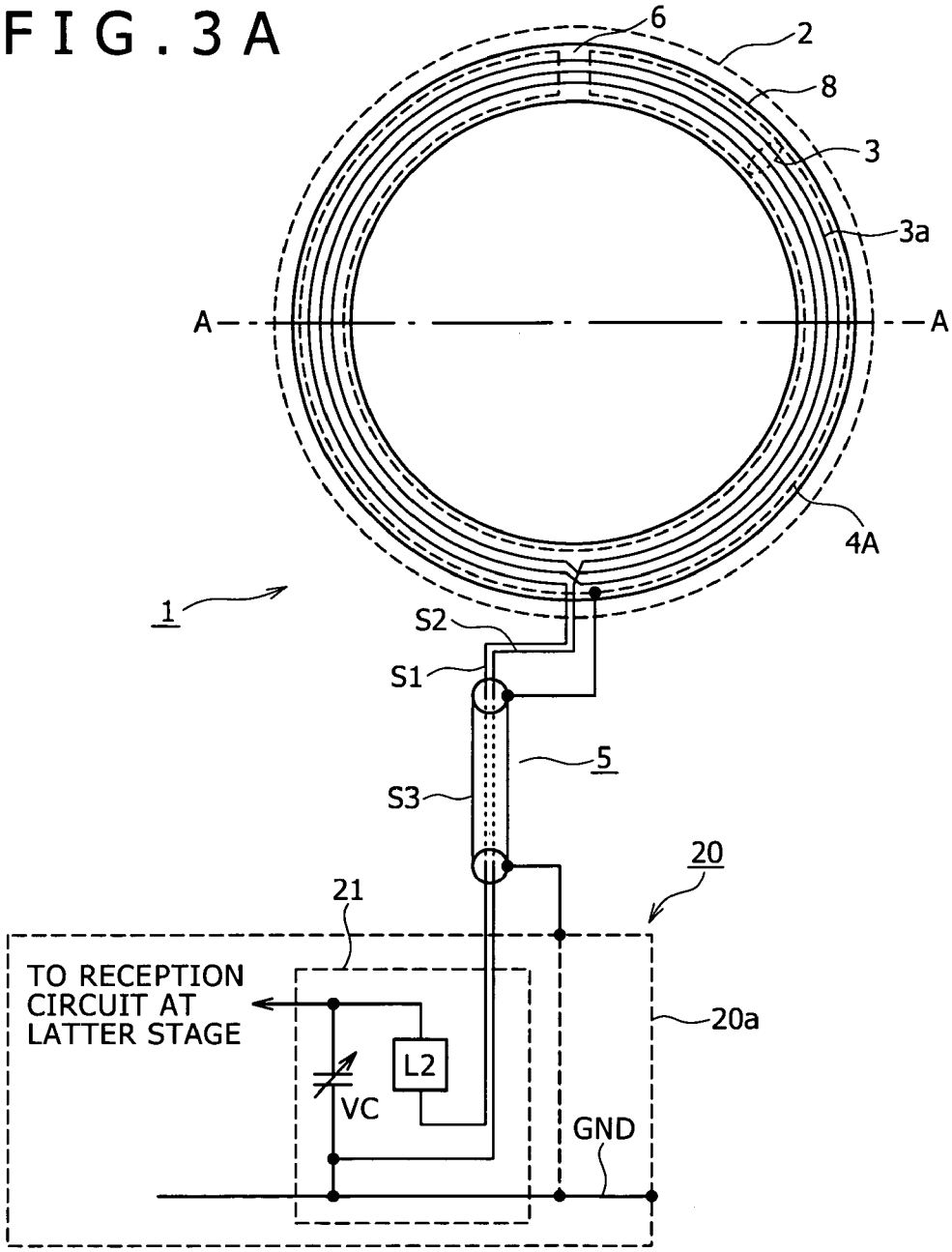
FIGS. 3A and 3B show an exemplary configuration of an AM antenna device according to a third embodiment of the present invention.
Figure 3B:
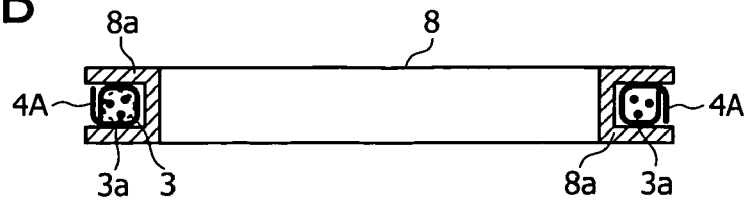

FIGS. 3A and 3B show an AM antenna device 1 as a third embodiment. FIG. 3A is a view, from the front side, of the AM antenna device 1, and FIG. 3B is a sectional view along line A-A of FIG. 3A. Incidentally, in these figures also, the same portions as those in FIGS. 1A, 1B, and 2 are denoted by the same symbols as used above, and description thereof will be omitted.

First, a loop antenna portion 2 shown in FIGS. 3A and 3B is provided with a ring-shaped spool member 8. As seen from FIG. 3B, the spool member 8 is provided with a spool portion 8*a* which is roughly angular U-shaped in section. Incidentally, the shape of the spool portion 8*a* may be, for example, a roughly U-shaped sectional shape, or the like; it suffices for the sectional shape of the spool portion to have a portion opened to the outer periphery side of the ring-like shape.

In the spool portion 8*a*, as shown in the figures, a conductive wire 3*a* is wound to form a looped conductor portion 3, and the looped conductor portion 3 is covered with a shield metallic foil 4A. The material of the shield metallic foil 4A is not particularly limited inasmuch as it is electrically conductive, and, for example, a foil material of aluminum or the like may be used.

In such a structure, the shield metallic foil 4A functions as a shield member for electrostatically shielding the looped conductor portion 3.

A non-covered portion 6 in this case is formed by providing a portion where the conductive wire 3*a* is not covered with the shield metallic foil 4A, at a portion corresponding to a reference position for the symmetry of connection portions for connecting both end portions of the conductive wire of the loop antenna portion to the reception circuit portion side, as shown in the figure.

Besides, a grounding structure for the loop antenna portion 2 by use of a feeder 5 shown in FIGS. 3A and 3B is the same as in FIGS. 1A and 1B.

Such a configuration is a structure which permits efficient assemblage in actually manufacturing the loop antenna portion based on the present invention. FIG. 4 shows assembly steps for the loop antenna portion 2 shown in FIGS. 3A and 3B. In FIGS. 4A to 4D, only the portion of a spool portion 8*a* of a spool member 8 is picked up and shown in enlarged form.

Figure 4A:
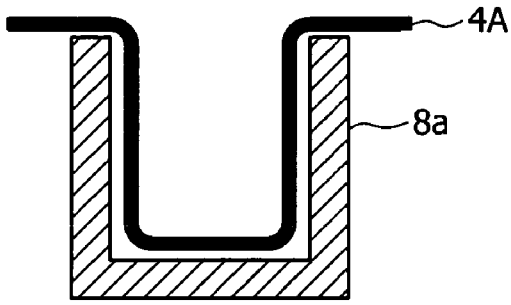
FIGS. 4A-4D show assembly steps of a loop antenna portion in the AM antenna device according to the third embodiment.

First, as shown in FIG. 4A, a shield metallic foil 4A is placed in the inside of the spool portion 8*a*, substantially along the inside shape of the spool portion 8*a*. Incidentally, in this case, the shield metallic foil 4A is not disposed at the portion to be the non-covered portion 6, as shown in FIG. 3A. Besides, in this case, surplus portions of the shield metallic foil 4A are allowed to project, for example, to both sides from an opening portion of the spool portion 8*a*.

Figure 4B:
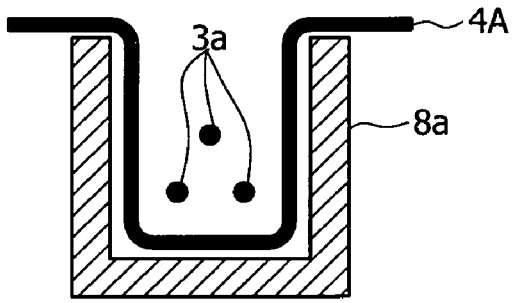

After the shield metallic foil 4A is placed as above, a conductive wire 3*a* is wound along the inside of the spool portion 8*a*, as shown in FIG. 4B. By this, as shown in FIG. 3B, the conductive wire 3*a* is wound in a loop form along the outer peripheral shape of the spool portion 8*a*, to form a looped conductor portion 3.

Figure 4C:
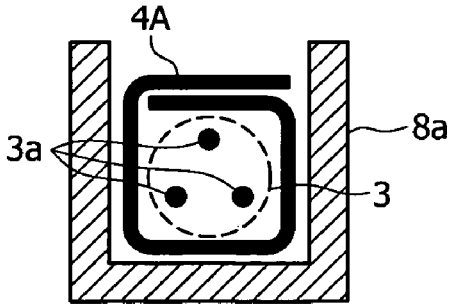

Thereafter, as shown in FIG. 4C, the shield metallic foil 4A having been protruding from the opening portion of the spool portion 8*a* is folded on the upper side of the opening portion so as to cover the periphery of the conductive wire 3*a*. As a result, the looped conductor portion 3 is covered with the shield metallic foil 4A.

Figure 4D:
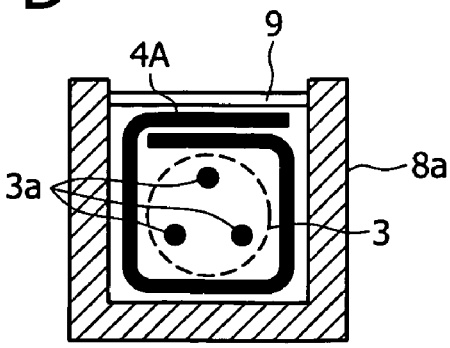

The assembling steps corresponding to the structure shown in FIGS. 3A and 3B are shown in FIGS. 4A to 4C. In this condition, however, for example, the shield metallic foil 4A is left exposed from the outer periphery of the spool portion 8*a*, and the conductive wire 3*a* is also exposed at the non-covered portion 6, which leads to easier damaging of the shield metallic foil 4A and the conductive wire 3*a* and is unfavorable on an aesthetic basis. In view of this, after the step of FIG. 4C, it is favorable to cover the whole part of the opening portion of the spool portion 8*a* with an insulating decorative tape 9 or the like, as shown in FIG. 4D.

For example, in the case of manufacturing the loop antenna portion of the structure shown in FIGS. 1A and 1B and FIGS. 5A to 5B, the conductive wire 3*a* needs to be passed through the pipe serving as the shield member, and the operation to obtain this condition cannot be said to be easy to carry out.

On the other hand, in the case of the steps shown in FIG. 4, the loop antenna portion can be gradually assembled in the manner of winding the required members around the spool member, so that the manufacturing process is easier to carry out.

In addition, for example, in manufacturing a loop antenna, it has been an ordinary practice to wind a conductive wire around a spool member. Therefore, it can be said that the steps shown in FIG. 4 make it possible to efficiently manufacture a loop antenna while using an existing spool member.

Incidentally, in the configuration of the loop antenna portion 2 shown in FIGS. 3A and 3B, the shield metallic foils 4A as shield members are close to each other, and the floating capacity between the conductive wire 3*a* and the shield metallic foil 4A increases accordingly. However, for example when the insulation coating on the outer periphery actually provided for the conductive wire 3*a* is formed with a required thickness, the spacing between the conductive wire 3*a* and the shield metallic foil 4A is sufficiently secured, so that the floating capacity can be easily reduced.

In addition, while the loop shape is a roughly circle circumference shape in each of the above embodiments, the loop shape may be a polygonal shape such as tetragon, triangle, etc.

Besides, while the loop antenna is an AM antenna in the above embodiments, loop antennas are being adopted for FM antennas and other antennas for various uses, and the present invention is applicable to loop antennas in general.

As has been described above, according to the present invention, in a loop antenna having a shield member covering a loop conductor portion formed in a loop shape from a conductive wire, a non-covered portion where the looped conductor portion is not covered is formed in correspondence with a portion of the conductive wire including a reference position for the symmetry of two terminals for connection between an antenna device and a reception circuit. By this configuration, a balanced shield structure can be obtained, so that the noise received by the loop antenna can be reduced, as compared for example with the case where a balanced shield structure is not adopted.

Further, a feeder cable has a covered wire covering a predetermined number of core wires for connecting the conductive wire to the reception circuit side, and the covered wire is connected between the shield member and the ground potential.

This ensures, for example, that a line for connecting one end of the conductive wire to the ground potential and a line for connecting the shield member to the ground potential are individually separate from each other, so that the reception of a voltage fall due to a common impedance by the antenna is suppressed, and noise resistance performance is enhanced.

In this manner, the antenna device according to the present invention realizes a higher noise resistance performance than that according to the related art, by combining the balanced shield structure with the grounding structure in which the grounding of the conductive wire and the grounding of the shield member are performed through different lines.

In addition, in the method of manufacturing an antenna device according to the present invention, first, a conductive foil member is placed relative to a spool portion, then a conductive wire as a looped conductor portion is wound around the spool portion to form the conductive wire into a loop shape, and the thus wound conductive wire is covered with a conductive foil member.

According to such a manufacturing method, an antenna device can be manufactured by simple operations of placing and winding a conductive foil member and a conductive wire relative to and around a spool portion. In addition, as for the spool member, an existing one can be used, and, therefore, there is no need to newly produce a component part as the spool member, which also makes it possible to enhance the efficiency of manufacture and is advantageous on a cost basis.

The invention claimed is:

1. An antenna device comprising:

a looped conductor portion comprised of a looped conductive wire;

a shield member covering a portion of the looped conductor portion, a non-covered portion of the looped conductor portion located in a position on the looped conductive wire diametrically opposite the position where the ends of the looped conductive wire are led out of the looped conductor portion toward a reception circuit;

a first line for connecting one end of the conductive wire to ground; and a second line, separate from the first line, for connecting the shield member to ground.

2. The antenna device as set forth in claim 1, further comprising:

a feeder cable for connecting the conductive wire in the looped conductor portion to the reception circuit, the feeder cable comprising:

a predetermined number of core wires including at least a core wire serving as the first line, and a covered wire that covers the core wires and is connected to the shield member and to ground.

3. The antenna device as set forth in claim 1, wherein the shield member comprises a pipe member having a loop shape corresponding to the loop shape of the looped conductor portion, a conductive member of the looped conductor portion is contained inside of the pipe member, and the non-covered portion of the looped conductor portion is where the conductive member of the looped conductor portion is not covered by the pipe member.

4. The antenna device as set forth in claim 1, further comprising:

at least one core wire as a conductive member of the looped conductor portion; and a covered wire as the shield member to cover the core wire, wherein a portion of the core wire not covered by the covered wire comprises the non-covered portion of the looped conductor portion.

5. The antenna device as set forth in claim 1, wherein the shield member is a conductive foil member that covers the outside of the looped conductor portion, and the non-covered portion of the looped conductor portion is where the conductive wire is not covered by the conductive foil member.

6. The antenna device as set forth in claim 5, further comprising a spool member wherein the conductive wire of the looped conductor portion, which is covered by the conductive foil member, is wound in a loop shape around the spool member.

7. A method of manufacturing an antenna device, comprising:

arranging a conductive foil member around a spool member, the conductive foil member being missing at a position on a loop diametrically opposite the position where the ends of a looped conductor portion will lead out of the antenna device toward a reception circuit;

winding a conductive wire as the looped conductor portion around the spool member on top of the conductive foil member; and folding the conductive foil member over the conductive wire so that the conductive wire is covered with conductive foil member.

* * * * *

UNITED STATES PATENT AND TRADEMARK OFFICE

CERTIFICATE OF CORRECTION

PATENT NO. : 7,345,644 B2
APPLICATION NO. : 10/549671
DATED : March 18, 2008
INVENTOR(S) : Susumu Morioka, Takashi Takano and Shigeru Saegusa It is certified that error appears in the above-identified patent and that said Letters Patent is hereby corrected as shown below:

In claim 7, column 12, lines 42-43, “with conductive” should read --with the conductive--.

Signed and Sealed this

Nineteenth Day of May, 2009

John Doll

JOHN DOLL
*Acting Director of the United States Patent and Trademark Office*